US005645224A

United States Patent [19]

Koch

[11] Patent Number: 5,645,224

[45] Date of Patent: Jul. 8, 1997

[54] MODULATING FLOW DIVERTER FOR A FUEL INJECTOR

[75] Inventor: Roger D. Koch, Pekin, Ill.

[73] Assignee: Caterpillar Inc., Peoria, Ill.

[21] Appl. No.: 411,132

[22] Filed: Mar. 27, 1995

[51] Int. Cl.[6] ..... F02M 47/00

[52] U.S. Cl. ..... 239/533.4; 239/533.8

[58] Field of Search ..... 239/88, 89, 91, 239/533.2–533.5, 533.9, 585.5, 584, 124

[56] References Cited

U.S. PATENT DOCUMENTS

| | | | |
|---|---|---|---|
| 2,896,856 | 7/1959 | Kravits | 239/132 |
| 4,200,231 | 4/1980 | Knape | 239/533.9 |
| 4,224,903 | 9/1980 | Mowbray | 123/300 |
| 4,258,883 | 3/1981 | Hofmann et al. | 239/124 |
| 4,315,603 | 2/1982 | Nakajima et al. | 239/533.3 |
| 4,412,657 | 11/1983 | Mowbray | 239/533.9 |
| 4,715,540 | 12/1987 | Miyake | 239/533.3 |
| 4,741,478 | 5/1988 | Teerman et al. | 239/88 |
| 4,840,310 | 6/1989 | Haider | 239/533.4 |
| 4,928,886 | 5/1990 | Kronberger | 239/533.5 |
| 5,094,397 | 3/1992 | Peters et al. | 239/89 |
| 5,125,580 | 6/1992 | Kronberger | 239/533.4 |
| 5,125,581 | 6/1992 | Kronberger | 239/533.5 |
| 5,429,309 | 7/1995 | Stockner | 239/88 |
| 5,445,323 | 8/1995 | Perr et al. | 239/124 |
| 5,487,508 | 1/1996 | Zuo | 239/533.9 |
| 5,505,384 | 4/1996 | Camplin | 239/533.5 |

FOREIGN PATENT DOCUMENTS

| | | |
|---|---|---|
| 0195440A2 | 3/1986 | European Pat. Off. . |
| 0255350A2 | 7/1987 | European Pat. Off. . |
| 3117-665 | 11/1982 | Germany . |
| 3900-762A | 7/1990 | Germany . |
| 52-21530 | 2/1977 | Japan . |
| 1201-544A | 12/1985 | U.S.S.R. . |
| 2140081 | 11/1984 | United Kingdom . |
| 2157366 | 10/1985 | United Kingdom . |
| 2230559 | 10/1990 | United Kingdom . |

*Primary Examiner*—Andres Kashnikow
*Assistant Examiner*—Lisa Ann Douglas
*Attorney, Agent, or Firm*—Mark D. Becker

[57] ABSTRACT

A unit fuel pump injector having a controlled leak path from the high pressure fluid volume surrounding the needle check in order to divert fuel flow away from the injection spray orifices. The fuel flow divertion occuring only during the injector operation when the check is traveling between its seat and its travel stop. This design improves the ability to modulate fuel delivery of unit injectors at low engine speeds and idle conditions and thereby eliminates or significantly reduces hunting or wandering of engine speed at such conditions while not significantly influencing the fuel delivered at large rack positions.

10 Claims, 4 Drawing Sheets

MODULATING FLOW DIVERTER FOR A FUEL INJECTOR

TECHNICAL FIELD

The present invention relates to fuel injectors for internal combustion engines and more particularly to modulation of the fuel injection to eliminate undesirable fuel delivery characteristics inherent in fuel injectors.

BACKGROUND ART

Satisfactory engine governing requires that the relationship of fuel delivery versus pump control rack or lever position be known. Ideally, the quantity of fuel delivered per stroke of an engine would increase linearly with rack position. However, unit fuel injectors for internal combustion engines which utilize a needle check type valve experience an undesirable change in the quantity of fuel delivered per stroke as the rack position changes. A typical fuel delivery curve is depicted by the upper curve shown in FIG. 1. The change in slope or knee in the fuel delivery versus rack position curve results in a portion of the curve having increased sensitivity to rack position. A minor change in rack position results in a large change in the fuel delivered to the cylinder.

This increased sensitivity causes difficulty controlling the speed of a diesel engine at low load or idle conditions. This results in "hunting" or "wandering" of the engine speed. Such engine speed instability results in difficulty maneuvering vehicles, difficulty controlling processes powered by the engine, failure of drive line components, and frequency variation of generator applications. The increased sensitivity to rack position can also make it difficult to match the fuel delivery of a set of fuel injectors. This can lead to uneven power distribution among the cylinders of an engine and can result in engine misfires.

The present invention is directed to overcome one or more of the problems as set forth above. The present invention provides a means whereby: (1) the knee of the fuel delivery versus rack position curve is lowered; and (2) the slope of the curve below the knee is made less steep without significantly affecting the fuel delivery at rack positions above the knee of the curve. The improved fuel delivery versus rack position curve is graphically depicted by the lower curve shown in FIG. 1.

DISCLOSURE OF THE INVENTION

In one aspect of the invention, an unit injector nozzle and tip assembly is provided having a case, a check tip having at least one fuel spray orifice, and a check sleeve. The check sleeve and the check tip define a high pressure fluid chamber. Both the check sleeve and check tip include a centrally disposed, longitudinal extending bore. The assembly includes a check being moveable within the check sleeve and check tip bore in response to fluid pressure in said high pressure fluid chamber. Elements are positioned for fluid communication with the high pressure fluid chamber for diverting fluid flow in a direction away from the orifices and high pressure fluid chamber in response to movement of the check.

In another aspect of the invention, an apparatus for modulating fuel delivery of a unit injector nozzle and tip assembly is provided. The apparatus includes a stop member having a longitudinal extending bore which defines a fuel discharge passage. Also included is a check sleeve having upper and lower end portions and a longitudinal extending bore which defines a fuel discharge passage that communicates with the fuel discharge passage of the stop member. The check sleeve includes a centrally disposed longitudinal extending sleeve bore. The sleeve bore further includes a counterbore at the upper end portion which defines a check spring cavity. The apparatus further includes a check spring having a longitudinal central bore and which is positioned within the check spring cavity. A check travel stop is positioned within the central bore of the check spring. A check tip having an upper end portion, a lower end portion, a plurality of spray orifices at said lower end portion, a check seat at said lower end portion, a longitudinal extending bore forming a high pressure fuel chamber communicating with said fuel discharge passage of said check sleeve, and a centrally disposed longitudinal extending bore which is aligned with the central bore of the check sleeve. A case retains the check tip, the check sleeve, and the stop member. A check having first and second end portions, a guide portion between said first and said second end portions, an outwardly extending lift spacer positioned at said first end portion. The check is movable within the check sleeve and the check tip bores and the check is biased by the check spring in a direction away from the check travel stop. Elements are located along the guide portion of the check for diverting fluid flow in a direction away from the spray orifices in response to movement of the check.

In another aspect of the invention, a method for modulating fuel injection of a unit fuel injector nozzle and tip assembly is provided. The method includes a first step of biasing a check towards a closed position. In this position, fluid communication is blocked between a high pressure fuel chamber and the fuel spray orifices. Second, a preselected volume of fuel is pressurized in the high pressure fuel chamber to a selected pressure. Third, the check is hydraulically moved towards an open position, against the biasing towards the closed check position. This step opens fluid communication between the high pressure fuel chamber and the fuel spray orifices and opens fluid communication between the high pressure fuel chamber and a spring cavity. Fourth, the check is hydraulically moved against a check travel stop. Fluid communication between the high pressure fuel chamber and the check spring cavity is blocked. Next the check is hydraulically balanced and biased toward the closed position. This opens fluid communication between the high pressure fuel chamber and the check spring cavity. Finally, the check is biased to the closed position blocking fluid communication between the high pressure fuel chamber and the check spring cavity and blocking fluid communication between the high pressure fuel chamber and the fuel spray orifices.

BRIEF DESCRIPTION OF THE DRAWINGS

FIG. 6 shows in a diagrammatic enlarged partial view of the upper end of the check within the nozzle and tip assembly of the unit injector when the check valve is fully open and the check is against the check travel stop.

BEST MODE FOR CARRYING OUT THE INVENTION

Figure 1:
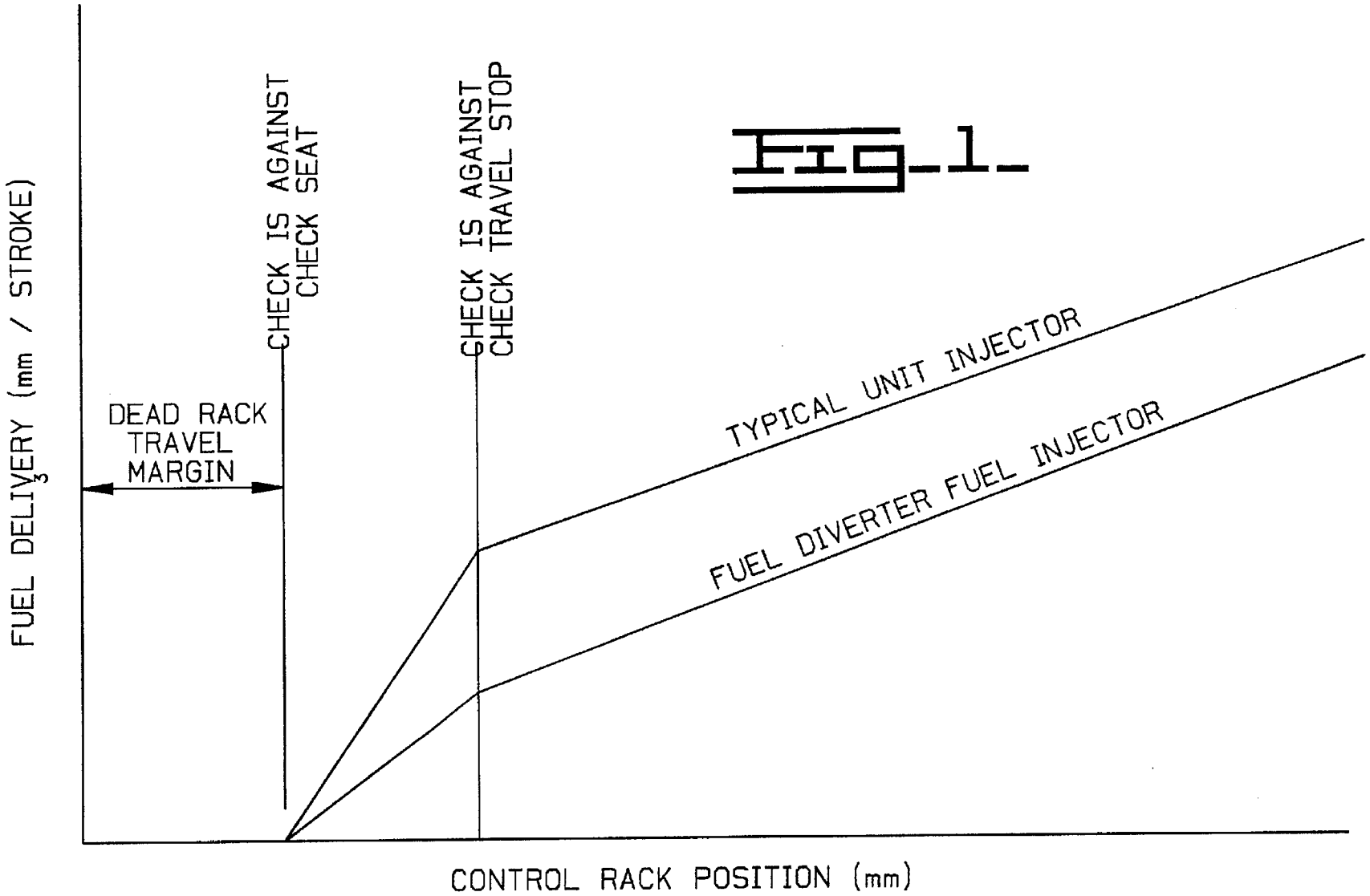
FIG. 1 is a graphical depiction of the quantity of fuel delivered at a predetermined rack position for both a typical unit injector and a unit injector incorporating a fuel diverter.

Referring to FIGS. 2–5, wherein the same reference numerals designate the same elements or features throughout all of the FIGS. 2–5, a first embodiment of a nozzle and tip assembly for a diesel-cycle internal combustion engine is shown. While a particular design unit injector is illustrated in FIGS. 2–5 and described herein, it should be understood the present invention is also applicable to all unit injectors. Also, the engine with which the fuel injection system may be used may comprise a diesel engine, a spark ignition engine or any other type of engine where it is necessary or desirable to inject fuel therein.

The fuel injection system may comprise a pump-line-injector system wherein the pump pressurizes the fuel flowing in the fuel lines to a relatively high pressure, for example 138 MPa (20,000 p.s.i.), and an internal check valve for each fuel injector is controlled electronically, hydraulically and/or mechanically to release the pressurized fuel into the cylinders associated therewith. Alternatively, the system may comprise a unit injector system wherein the pump supplies fuel at a relatively low pressure of, for example, 0.414 MPa (60 p.s.i.), to the injectors. The injectors include means for pressurizing the fuel to a relatively high pressure of, for example, 138 MPa (20,000 p.s.i.) and an internal check valve is operated to admit the pressurized fluid into the associated cylinders.

Figure 2:
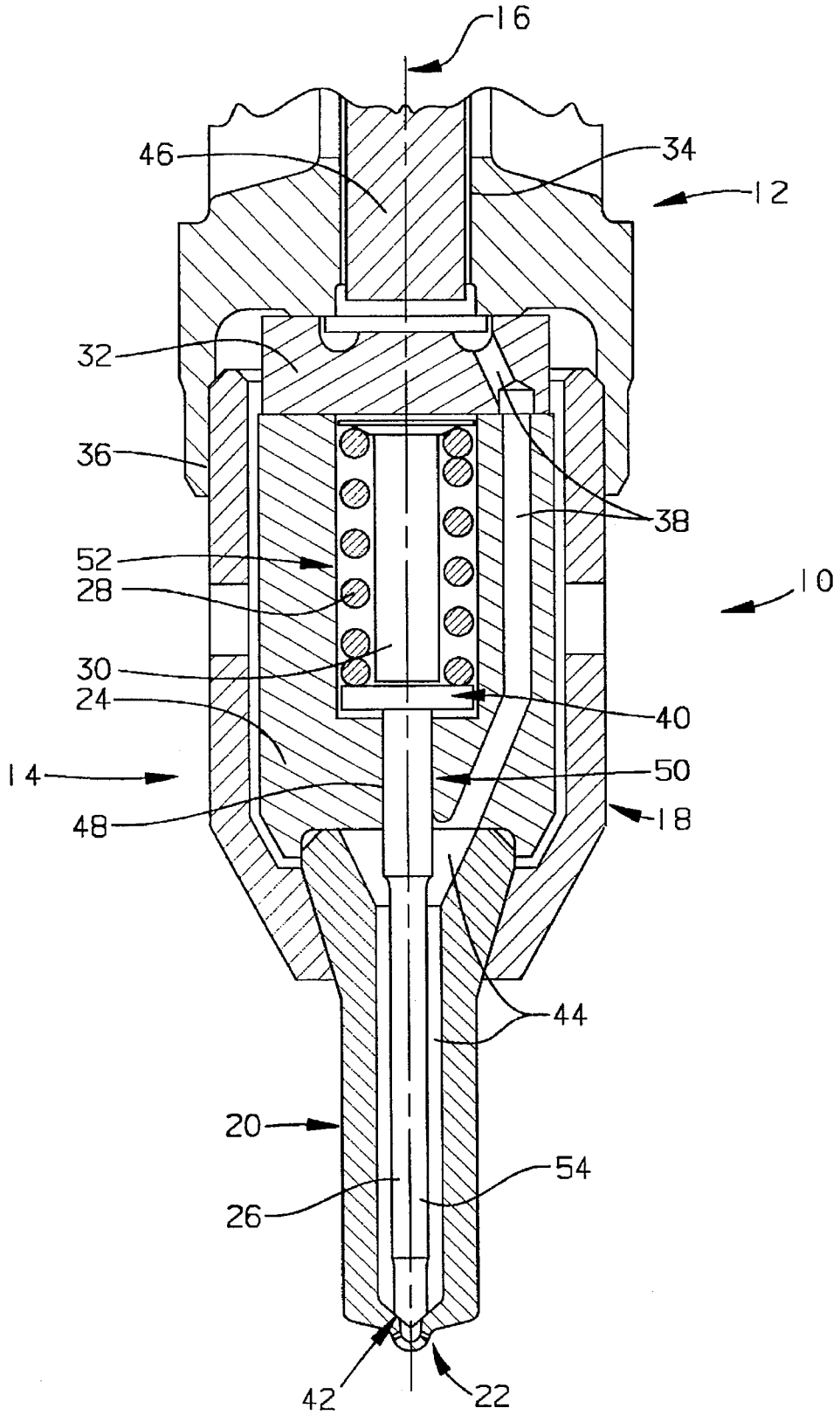
FIG. 2 is a longitudinal sectional view of the lower portion of unit injector with a needle check valve.

Referring to FIG. 2, the unit injector lower end portion 10, includes a barrel assembly 12, and a nozzle and tip assembly 14 and has a longitudinal axis 16. The nozzle and tip assembly is provided as a means or device for communicating high pressure fuel from the fuel pumping chamber 34, in the barrel assembly 12, to the cylinders of an internal combustion engine (not shown).

The barrel assembly 12, includes a plunger 46 and fuel pump chamber 34. The plunger 46 moves in a reciprocal motion by external force applied upon it by hydraulic or mechanical means. The stroke of the plunger movement is dependent on the construction of the unit injector and the requirements of the installation. The barrel assembly and plunger are provided to increase fluid pressure within the unit injector to a level required to inject fuel at the correct flowrate, timing, and obtain proper atomization of the fluid particle.

As shown in FIG. 2, the nozzle and tip assembly 14 includes, a case 18, a check tip 20 which has at least one but preferably a plurality of spray orifices 22, at its lower end portion, a check sleeve 24, a check 26, a check spring 28, a check travel stop 30 and a stop member 32.

The cup-shaped case 18, encloses and retains the stop member 32, check sleeve 24, and check tip 20 against the barrel assembly 12. The case 18, preferably includes external threads 36 at its upper end portion for engaging and retaining the nozzle and tip assembly 14 against the barrel assembly 12.

The stop member 32 and check sleeve 24 include at least one but preferably a plurality of fuel discharge passages 38, which are adapted for communicating high pressure fuel from the fuel pumping chamber 34, to the high pressure fluid chamber 44 which includes the volume surrounding the check lower end portion 54 and is defined by the check tip 20 and check sleeve. The fuel discharge passages 38 and high pressure fluid chamber 44, communicate high pressure fuel to at least one by preferably a plurality of spray nozzles 22 in the check tip lower end portion.

The check sleeve 24, includes a longitudinal extending sleeve bore 48, preferably centrally disposed, being of a diameter adapted to insertion of the check guide portion 50 of the check 26. The bore is constructed to have a very small diameteral clearance between the check guide portion 50 and the sleeve bore 48. The check sleeve further includes a check spring cavity 52 which is a counterbore at the upper end portion of the check sleeve 24. Within the check spring cavity 52 is the lift spacer 40, the check spring 28, and the check travel stop. Preferably the check spring 28 is a helical spring with a centrally disposed spring cavity.

Figure 3:
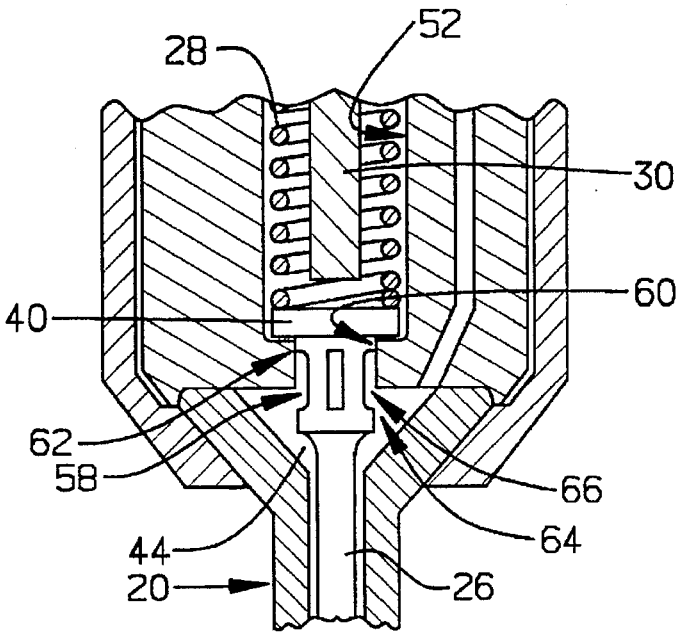
FIG. 3 shows in a diagrammatic enlarged partial view of the upper end of the check within the nozzle and tip assembly of the unit injector when the check valve is closed and the check is biased against the check seat.

The check 26 and the check tip 20 are preferably of the valve-closed-orifice type. Referring to FIG. 2 and 3, the check spring 28 normally biases the lift spacer 40 and check 26 downward so that the check 26 is seated against the annular check seat 42 of the check tip 20 and the lift spacer 40 is spaced apart from the check travel stop 30.

Figure 4:
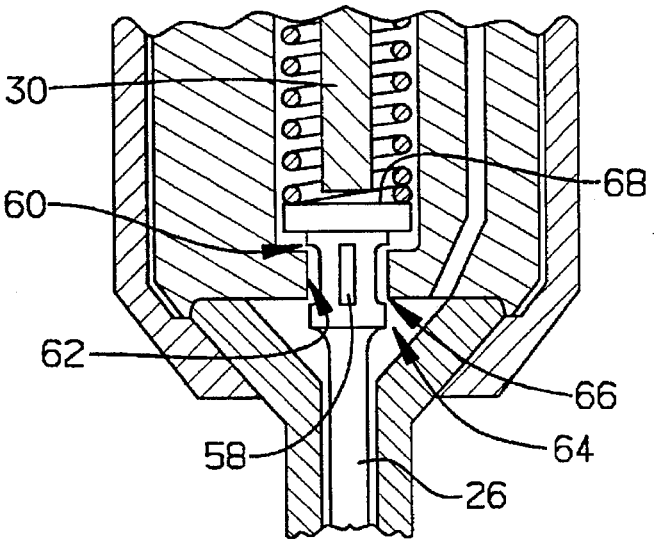
FIG. 4 shows in a diagrammatic enlarged partial view of the upper end of the check within the nozzle and tip assembly of the unit injector when the check valve is transitioning between the fully closed and the fully open positions.
Figure 5:
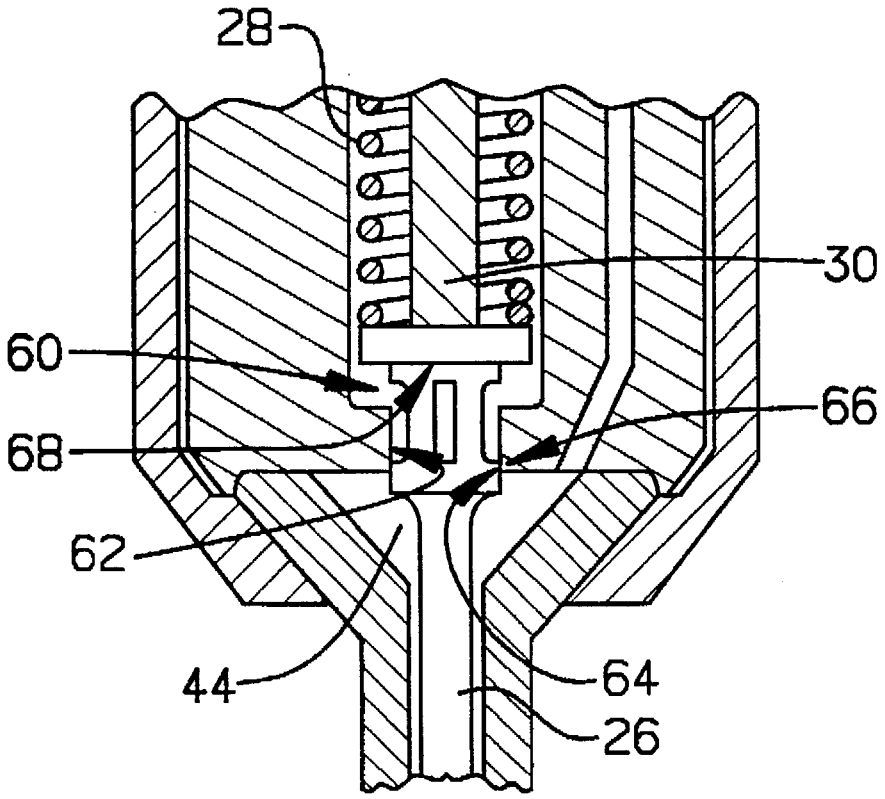

As shown in FIGS. 3–5, the check 26 and check sleeve 24 form a means or device for diverting a controlled quantity of fluid from the high pressure fluid chamber in a direction away from the spray orifices in response to movement of the check 26. The check 26, is moveable along the longitudinal axis 16, between three positions in response to fluid pressure in the high pressure fuel chamber. FIGS. 3–5 show the three positions of the check 26, and the corresponding position of the controlled leak path.

FIG. 3 shows the check in the first check position. In this position, fluid communication between the high pressure fluid chamber 44 and the spray orifices 22 is blocked. Also fluid communication between the high pressure fluid chamber 44 and the controlled leak path is blocked.

As the plunger, 46 in the barrel assembly, 12 moves in a downward direction, relative to the orientation shown in FIG. 2, the pressure of the fluid in the fuel pumping chamber 34, fuel discharge passages 38 and high pressure fluid chamber 44 increases. Referring to FIG. 4, when the fluid pressure in the high pressure chamber increases to a sufficiently high level, the pressure acting on the check 26 will overcome the biasing of the check spring 28 in a closed direction, and the check 26 and lift spacer 40 will move in an upward direction, relative to the direction shown in FIGS. 2–5 to an intermediate check position. In the check intermediate position, the lift spacer 40 is spaced apart from the check travel stop 30 and the check 26 is spaced from the annular check seat 42 of the check tip 20. Fluid communication between the high pressure fluid chamber 44 and the spray orifices 22 is opened and fluid communication between the high pressure fluid chamber 44 and the controlled leak path is opened. This leak path allows a preselected quantity of fluid to flow into the check spring cavity 52.

Referring to FIG. 5, as the plunger 46, in the barrel assembly 12, continues to move in a downward direction, the pressure of the fluid in the fuel pumping chamber 34, fuel discharge passages 38 and high pressure fluid chamber 44 increases to a sufficiently high level to overcome the biasing of the check spring 28 in a closed direction and the check 26 and lift spacer 40 move in an upward direction, relative to the direction shown in FIGS. 2–5 to a third check position. In the third check position, the lift spacer 40 is moved into contact with the check travel stop 30 and the check 26 is spaced from the annular check seat 42 of the check tip 20.

Fluid communication between the high pressure fluid chamber 44 and the spray orifices 22 is fully opened and fluid communication between the high pressure fluid chamber 44 and the controlled leak path is again blocked. At this position, the leak path allowing fluid to flow into the check spring cavity 52 is blocked.

Fluid communication between the high pressure fluid chamber 44, and the controlled leak path occurs when the check 26 is moving between the fully closed and the fully open positions or in other words from the check first position to the check third position. The leak path is also open and allowing fluid communication again when the check is transitioning between the fully open and fully closed positions. At the first and third check positions, fluid communication to the controlled leak path from the high pressure fluid chamber is blocked.

In one embodiment of the invention, the controlled leak path includes at least one but preferably a plurality of peripherally spaced longitudinal check grooves 58 which are machined into the check guide portion 50.

Referring to FIG. 3, the check grooves are constructed such that fluid is not diverted away from the spray orifices 22 when the check is in its fully closed or first position. When the check 26 is in the closed or first position, the check 26 is seated against the annular check seat 42 blocking fluid communication between the high pressure fluid chamber 44 and the spray orifices 22. At the check first position, the check groove lower seat 64, is spaced apart from the check sleeve lower seat 66, allowing fluid communication between the high pressure fluid chamber 44 and the check grooves 58; however, the check groove upper seat 60, is seated against the check sleeve upper seat 62, blocking fluid communication from the high pressure fluid chamber 44 and check grooves 58 to the check spring cavity 28 and not allowing fluid flow to be diverted away from the spray orifices 22.

As shown in FIG. 4, the check grooves are constructed such that fluid is diverted away from the spray orifices 22 when the check is at its intermediate position or in other words, when the check is transitioning between its fully closed or first position and its fully open or third position and back again. When the check 26 is in the intermediate position, the check 26 is spaced apart from the annular check seat 42 opening fluid communication between the high pressure fluid chamber 44 and the spray orifices 22; however, the lift spacer upper end portion 68 is not against the check travel stop 30. At the check intermediate position the check groove upper seat 60 is spaced apart from the check sleeve upper seat 62 and the check groove lower seat 64 is spaced apart from the check sleeve lower seat 66, opening fluid communication from the high pressure fluid chamber 44 to the check spring cavity 28 diverting a preselected quantity of fuel away from the spray orifices 22.

Referring to FIG. 5, the check grooves are of a construction such that fluid is not diverted from the high pressure fluid chamber 44 and away from the spray orifices 22, when the check is at its third position, or in other words, when the check is fully open. When the check 26 is in the third position, the fluid pressure in the high pressure fluid chamber is sufficient to overcome the biasing force of the check spring 28, and the check 26, is spaced apart from the annular check seat 42, opening fluid communication between the high pressure fluid chamber 44 and the spray orifices 22, and the lift spacer upper end portion 68 is seated against the check travel stop 30. At the check third position the check groove upper seat 60, is spaced apart from the check sleeve upper seat 62, and the check groove lower seat 64, is seated against the check sleeve lower seat 66, blocking fluid communication from the high pressure fluid chamber 44, to check grooves 58 and the check spring cavity 52 and not allowing high pressure fluid to be diverted in a direction away from the spray orifices 22.

The preferred dimensions of the controlled leak path are a function of the preselected quantity of fuel to be diverted during the beginning of the injection period and are application dependent. The size of the leak path is a function of the check valve maximum lift closing and opening pressure desired which is depended on the injector size and fluid flowrate. The leak path preferably is constructed such that the leak path only allows fluid communication while the check 26, is traveling between the annular check seat 42, and the check travel stop 30, which minimizes the change in the rack position necessary to initiate check lift. The leak path preferably is sized and constructed such that the total fuel delivered at large rack values is not significantly changed.

Industrial Applicability

The fuel injector includes a fuel inlet passage which is disposed in fluid communication with the fuel supply line. When injection into an associated cylinder is to occur, pressurized fuel is admitted through the fuel inlet passage into the fuel discharge passage 38 and the fuel pumping chamber 34. When the pressure within the chamber 34 reaches a valve opening pressure VOP, check lift occurs, thereby spacing the check 26 from the annular check seat 42 and permitting pressurized fuel to escape through the spray nozzle orifice 22 into the associated cylinder.

At and following the moment of check lift, the pressure in the high pressure fluid chamber 44 increases and then decreases in accordance with the pressure in the fuel pumping chamber 34 until a valve closing pressure VCP is reached, at which point the check returns to the closed position.

The improvement to the unit injector described above diverts a preselected quantity of fuel away from the injection spray orifices at the initial check lift while fuel pressure which is not sufficient to move the check 26 to its fully open position. This diverting of fuel also occurs just prior to the valve closing pressure being obtained while the check is transitioning to the fully closed position. This diverting of fuel from the spray orifices improves the ability to modulate fuel delivery of unit injectors at low load or idle conditions and thereby eliminates or significantly minimizes hunting or wandering of engine speed at those conditions.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

Other aspects, objects and advantages of this invention can be obtained from a study of the drawings, the disclosure and the appended claims.

What is claimed is:

1. A unit injector nozzle and tip assembly having a case, a check tip having at least one fuel spray orifice, a check sleeve, a high pressure fluid chamber defined by said check sleeve and said check tip, each of said check sleeve and said check tip having a longitudinal extending bore, the improvement comprising:

a check being moveable between an open position and a closed position within said check sleeve and said check tip bore in response to fluid pressure in said high pressure fluid chamber;

a controlled leak path in fluid communication with the high pressure fluid chamber for diverting fluid flow in a direction away from said at least one spray orifice as said check moves between said open and said closed positions.

2. A unit injector nozzle and tip assembly, as set forth in claim 1, wherein said check is moveable in response to fuel pressure between a first position at which fluid communication between said high pressure fluid chamber and said controlled leak path is blocked, an intermediate position at which there is fluid communication between said high pressure fluid chamber and said controlled leak path and a third position at which fluid communication between said high pressure fluid chamber and said controlled leak path is blocked.

3. A unit injector nozzle and tip assembly, as set forth in claim 2, wherein fluid communicates between said high pressure fluid chamber and said leak path at a location of said check between said first and said third positions.

4. An apparatus for modulating fuel delivery of a unit injector nozzle and tip assembly, comprising:

a stop member having a longitudinal extending bore defining a fuel discharge passage;

a check sleeve having upper and lower end portions, a longitudinal extending bore defining a fuel discharge passage and being of a construction to allow fluid communication with said fuel discharge passage of said stop member, and a centrally disposed longitudinal extending sleeve bore, said sleeve bore further including a counterbore at said upper end portion defining a check spring cavity;

a check spring having a longitudinal central bore and being positioned within said check spring cavity;

a check travel stop positioned within said central bore of said check spring;

a check tip having an upper end portion, a lower end portion, a plurality of spray orifices at said lower end portion, a check seat at said lower end portion, and a longitudinal extending bore forming a high pressure fuel chamber communicating with said fuel discharge passage of said sleeve, and a centrally disposed longitudinal extending bore being adapted to align with said check sleeve bore;

a case being of a construction sufficient for retaining said check tip, said check sleeve, and said stop member;

a check having first and second end portions, a guide portion between said first and said second end portions, an outwardly extending lift spacer positioned at said first end portion, said check being moveable within said check sleeve bore and check tip bore, and;

a means located along said guide portion of said check for diverting fluid flow in a direction away from said spray orifices in response to movement of said check.

5. An apparatus to modulate fuel delivery for a unit injector nozzle and tip assembly, as set forth in claim 4, said means including a plurality of peripherally-spaced longitudinal grooves positioned on the guide portion, each of said grooves having an upper end portion and a lower end portion, said check being slidably positioned within said sleeve bore and check tip bore and being moveable between a first position at which there is fluid communication between the high pressure fluid chamber and the lower end portion of said check grooves and fluid communication between the upper end portion of the grooves and the spring cavity is blocked, an intermediate position at which there is communication between said high pressure chamber and said spring cavity, and a third position at which fluid communication between the high pressure chamber and the lower end portion of the check grooves is blocked.

6. An apparatus to modulate fuel delivery for a unit injector nozzle and tip assembly, as set forth in claim 5, wherein said check spring biases said check lower end portion against said check seat when the check is at said first position and said lower end portion of said check is longitudinally spaced from said check seat at said intermediate and third positions.

7. An apparatus for modulating fuel delivery of a unit injector nozzle and tip assembly, as set forth in claim B, wherein said lift spacer is longitudinally spaced from said check travel stop at said first position of said check and said lift spacer is against said check travel stop when the check is in said third position.

8. An apparatus to modulate fuel delivery for a unit injector nozzle and tip assembly, as set for in claim 6, wherein fluid flow is diverted in a direction away from said orifices during movement of the check between said first and said intermediate check positions, and fluid flow is diverted in a direction away from said orifices during movement of the check between said intermediate and said third check positions.

9. A method for modulating fuel injection of a fuel injector nozzle and tip assembly, comprising the steps of:

biasing a check towards a closed position blocking fluid communication between a high pressure fuel chamber and a fuel spray orifice;

pressurizing a preselected volume of fuel in the high pressure fuel chamber to a selected pressure;

hydraulically moving the check towards an open position, against the biasing towards the closed check position, opening fluid communication between the high pressure fuel chamber and the fuel spray orifices and diverting a preselected quantity of fuel away from the high pressure fuel chamber and fuel spray orifices;

hydraulically moving the check against a check travel stop, blocking fluid diverting from the high pressure fuel chamber and the fuel spray orifices;

hydraulically balancing the check and biasing the check toward the closed position, diverting a preselected quantity of fuel away from the high pressure fuel chamber and fuel spray orifices; and, biasing the check to the closed position blocking fluid communication between the high pressure fuel chamber and the fuel spray orifices and blocking fluid diverting from the high pressure fuel chamber.

10. A method for modulating fuel injection of a fuel injector nozzle and tip assembly, comprising the steps of:

biasing a check towards a closed position blocking fluid communication between a high pressure fuel chamber and a fuel spray orifice;

pressurizing a preselected volume of fuel in the high pressure fuel chamber to a selected pressure;

hydraulically moving the check towards an open position, against the biasing towards the closed check position, opening fluid communication between the high pressure fuel chamber and the fuel spray orifices and opening fluid communication between the high pressure fuel chamber and a spring cavity;

hydraulically moving the check against a check travel stop and blocking fluid communication between the high pressure fuel chamber and the check spring cavity;

hydraulically balancing the check and biasing the check toward the closed position, opening fluid communication between the high pressure fuel chamber and the check spring cavity; and, biasing the check to the closed position blocking fluid communication between the high pressure fuel chamber and the check spring cavity and blocking fluid communication between the high pressure fuel chamber and the fuel spray orifices.

* * * * *

UNITED STATES PATENT AND TRADEMARK OFFICE

CERTIFICATE OF CORRECTION

PATENT NO. : 5,645,224

DATED : July 8, 1997

INVENTOR(S) : Roger D. Koch

It is certified that error appears in the above-identified patent and that said Letters Patent is hereby corrected as shown below:

Claim 7: Line 2 -- delete Claim B and insert --claim 5--

Signed and Sealed this

Second Day of December, 1997

*Attest:*

*Attesting Officer*

Bruce Lehman

BRUCE LEHMAN

*Commissioner of Patents and Trademarks*